US007896297B1

(12) United States Patent
Simone

(10) Patent No.: US 7,896,297 B1
(45) **Date of Patent: *Mar. 1, 2011**

(54) BABY ACCESSORY LEASH

(76) Inventor: Rachelle K Simone, Albuquerque, NM (US)

( * ) Notice: Subject to any disclaimer, the term of this patent is extended or adjusted under 35 U.S.C. 154(b) by 125 days.

This patent is subject to a terminal disclaimer.

(21) Appl. No.: 12/228,558

(22) Filed: Aug. 13, 2008

Related U.S. Application Data

(63) Continuation-in-part of application No. 11/432,458, filed on May 11, 2006, now Pat. No. 7,419,125.

(60) Provisional application No. 60/692,693, filed on Jun. 20, 2005, provisional application No. 60/684,662, filed on May 25, 2005, provisional application No. 60/681,331, filed on May 13, 2005.

(51) Int. Cl.
*A47D 15/00* (2006.01)

(52) U.S. Cl. ..... 248/102; 248/104; 248/908

(58) Field of Classification Search ..... 248/102, 248/104, 205.1, 908; 24/31.13, 300, 301, 24/302; 224/148.5, 148.6, 572, 926
See application file for complete search history.

(56) References Cited

U.S. PATENT DOCUMENTS

| | | | | |
|---|---|---|---|---|
| 2,711,052 | A * | 6/1955 | Brayford | 446/73 |
| 5,582,337 | A * | 12/1996 | McPherson et al. | 224/660 |
| 2003/0015630 | A1 * | 1/2003 | Fishler | 248/102 |
| 2004/0079843 | A1 * | 4/2004 | Medwed et al. | 248/104 |
| 2005/0050695 | A1 * | 3/2005 | Mackey et al. | 24/300 |
| 2005/0115996 | A1 * | 6/2005 | Deike | 224/148.6 |
| 2007/0062012 | A1 * | 3/2007 | Caison | 24/302 |

* cited by examiner

*Primary Examiner*—Ramon O Ramirez
(74) *Attorney, Agent, or Firm*—Richard K Thomson

(57) ABSTRACT

A leash for a baby accessory including a bottle or other food/beverage container, toy or the like, has a padded band with a redundant attachment to the shoulder harness strap of a car seat. Similarly, the second attachment strap for attaching to the bottle has a redundant set of latches to ensure that the bottle is held thereby. The strap suspending the bottle has a dangle length of 3" to 5" to maintain the bottle within easy reach of the child obviating intervention by the parent to restore control of the container to the baby. The second attachment strap is provided with a non-slip fabric for engaging the surface of the container. The suspension strap is afforded with interchangeable clips which permit a bottle leash to be converted to a toy leash.

16 Claims, 7 Drawing Sheets

BABY ACCESSORY LEASH

This application is a continuation-in-part of U.S. patent application Ser. No. 11/432,458 filed May 11, 2006, now U.S. Pat. No. 7,419,125.

In the parent application, Applicant claimed priority of provisional patent application 60/681,331 filed May 13, 2005, provisional patent application 60/684,662 filed May 25, 2005, and 60/692,693 filed Jun. 20, 2005.

BACKGROUND AND SUMMARY OF THE INVENTION

One of the (many) difficulties in traveling with infants and young children, is keeping them entertained. If the child is hungry or thirsty, often a toy, bottle or sippy cup will serve to provide the parent(s) a brief respite from the vocal displeasure of a cranky passenger. All too often, however, the solution to the crabbiness problem becomes, instead, a problem in itself. The baby repeatedly drops the drink/liquid-food container or toy requiring the non-driving parent to unfasten their seat belt and lean over the seat-back to gain access to the container or toy which is, doubtlessly, rolling around on the floor in the least reachable location possible. This procedure is both aggravating and difficult for even the most well-conditioned parent, as well as a distraction to the driver. Should there be only a single adult in the vehicle, the maneuver, to be properly and safely done, requires stopping the vehicle by the roadside to afford the driver free hands to access the dropped item. Depending on the traffic flow and neighborhood of the mishap, this technique may not be all that safe, either. An equally aggravating, if generally safer, time awaits the parent pushing a stroller through the mall with the added complication that the dropped item may go undetected for a number of stores.

Several attempts at dealing with this situation have appeared in the patent literature. Some of these developments ease the parent's difficulty of locating the container: they need merely follow the string which is tied to the car seat to its end and, voila!, there's the baby's bottle. However, the retrieval still requires the non-driving parent (if any) to unfasten their seat belt and rummage around in the back seat to restore the drink container to the child. Another problem which arises with some of the available bottle suspenders is that the shoulder strap connections and the bottle attachments can both be tampered with. When the child has drunk her/his fill and is looking for an alternate form of entertainment, these disconnectable devices provide an all-too-ready "toy", defeating this supposed solution to the "bottle drop" problem.

It is a primary object of the present invention to provide a leash system for a bottle/beverage container which 1) maintains the bottle within easy reach of the child and, 2) can be easily converted to tether a toy, binky or the like. This is accomplished by having a short (on the order of 3-5 inches) leash which has a first portion that attaches to the seat belt harness or shoulder strap of a stroller and a second detachable portion that suspends the bottle, toy or binky in the area of the child's chest region. This keeps the item within easy reach should the elusive bottle slip from her/his grasp. In addition, the securement means attaching the leash to the shoulder strap and the latching means attaching the leash to the bottle are child-proof: either the clip is an alligator (suspender) clip, and/or the attachment is enshrouded with a Velcro-secured wrap which makes it tamper-proof. The second detachable portion is attached to the first by a side release clip, a middle release clip, a spring clip, a snap, or a button. Toddlers lack the manual dexterity and finger strength necessary to manipulate such devices and so the clip remains attached. This allows a bottle wrap to be replaced by a toy wrap. It is desirable that the elastic band forming the toy wrap be incorporated into the arms/appendages of a teddy bear or other stuffed animal so that the separated second detachable portion not become a choking hazard.

The present invention includes a leash system for a child's accessory, the leash system comprising a) a strap having a first fabric length with a first and second end; b) a first securement means for attaching the first fabric length to a fixed location, the first securement means comprising a tamper-proof clip; c) a second attachment band secured to the second end of the strap for securely attaching to the child's accessory; whereby the first securement means and the second attachment band provide a fail-safe leash system for maintaining the child's accessory within reach of a child. The tamper-proof clip is selected from a group consisting of an alligator clip, a center-release clip, a side release clip, snap hook, spring clip, swivel snap hook, snaps and buttons. Most preferably, the tamper-proof clip is an alligator clip. Also, it is preferred that the second attachment band is adjustable to accommodate different sized articles. This adjustment may take the form of the second attachment band being a stretchable elastic material to accommodate different sized articles. In addition, the length of the strap may have adjustment means allowing its length to be altered.

In order to remove the second attachment band from the realm of being a choking hazard, a toy is irremovably attached to the second attachment band should it become disassociated with the strap. The toy preferably comprises a stuffed animal whose arms are integral with the second attachment band. The stuffed animal preferably comprises a teddy bear whose hands may be the two halves of a side release clip or Velcro equipped to wrap around a toy or other article, such as a binky. It will be understood that a) the paws could terminate with side release clips or Velcro fabric strips, b) two pairs of paws could be used to grasp the toy or bottle and, c) that some stuffed animals (i.e., a kangaroo), can provide pouches to receive the article.

The leash system for a child's accessory of the present invention, includes a) first securement means for attaching the leash to a fixed location; b) a first clip securable to the first securement means, the first clip being attached to a first end of a first length of fabric, a first attachment band secured to a second end of the first length of fabric, the first attachment band being adapted to secure a first type of child's accessory; c) a second clip securable to the first securement means, the second clip being attached to a first end of a second length of fabric, a second attachment band secured to a second end of the second length of fabric, the second attachment band being adapted to secure a second type of child's accessory; whereby said first and second clips may alternatively be attached to the first securement means to enable the leash system to accommodate multiple types of child accessories. The first securement means includes a second securement means surrounding the first securement means preventing tampering with the first securement means. This second securement means may comprise a padded fabric band to ensure the child's comfort. The band of the second securement means is retained in a wrapped position by first and second portions of hook-and-loop fabric.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
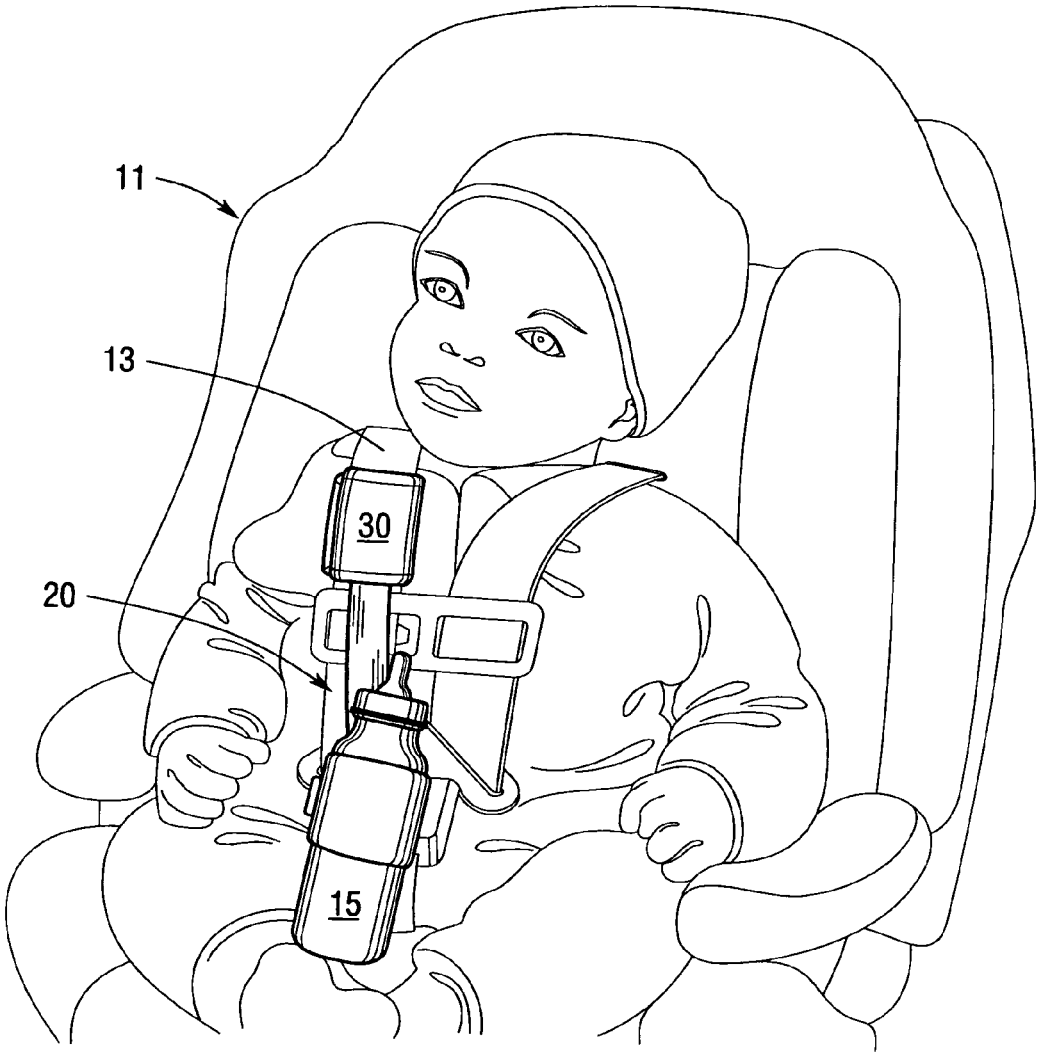
FIG. 1 is a perspective front view of a first embodiment of the baby bottle leash of the present invention shown attached to a car seat.
Figure 2:
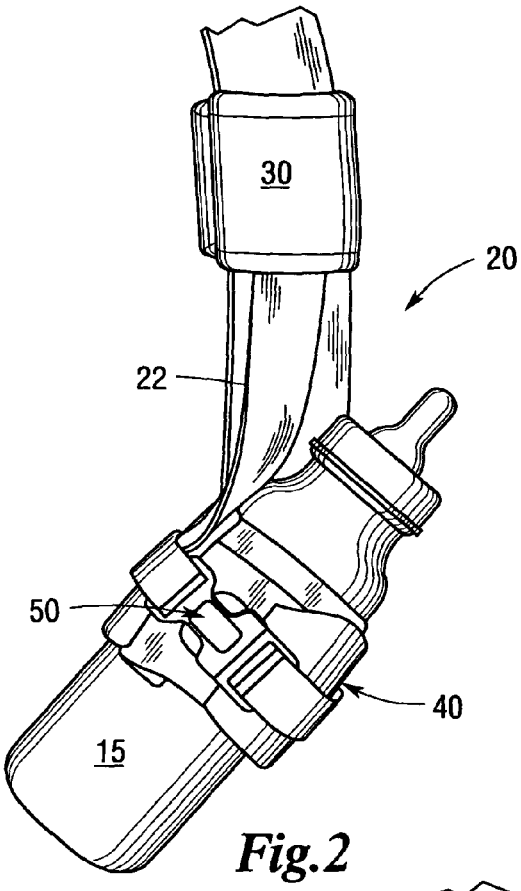
FIG. 2 is a detailed front view of the first embodiment of the baby bottle leash of the present invention with the bottle turned to enhance depicting certain details.
Figure 4A:
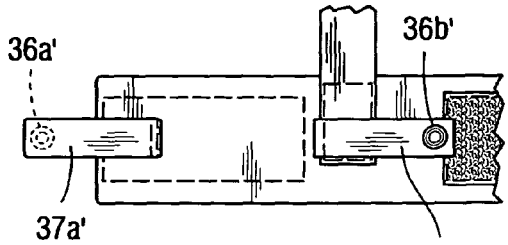
FIG. 4A is a partial front view of a second embodiment of the baby bottle leash of the present invention.
Figure 4B:
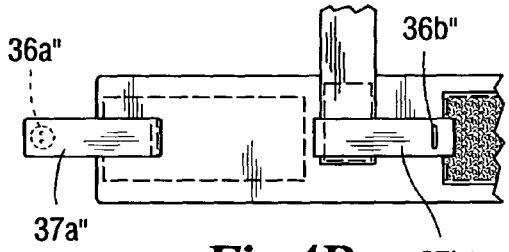
FIG. 4B is a partial front view of a third embodiment of the baby bottle leash of the present invention.
Figure 4:
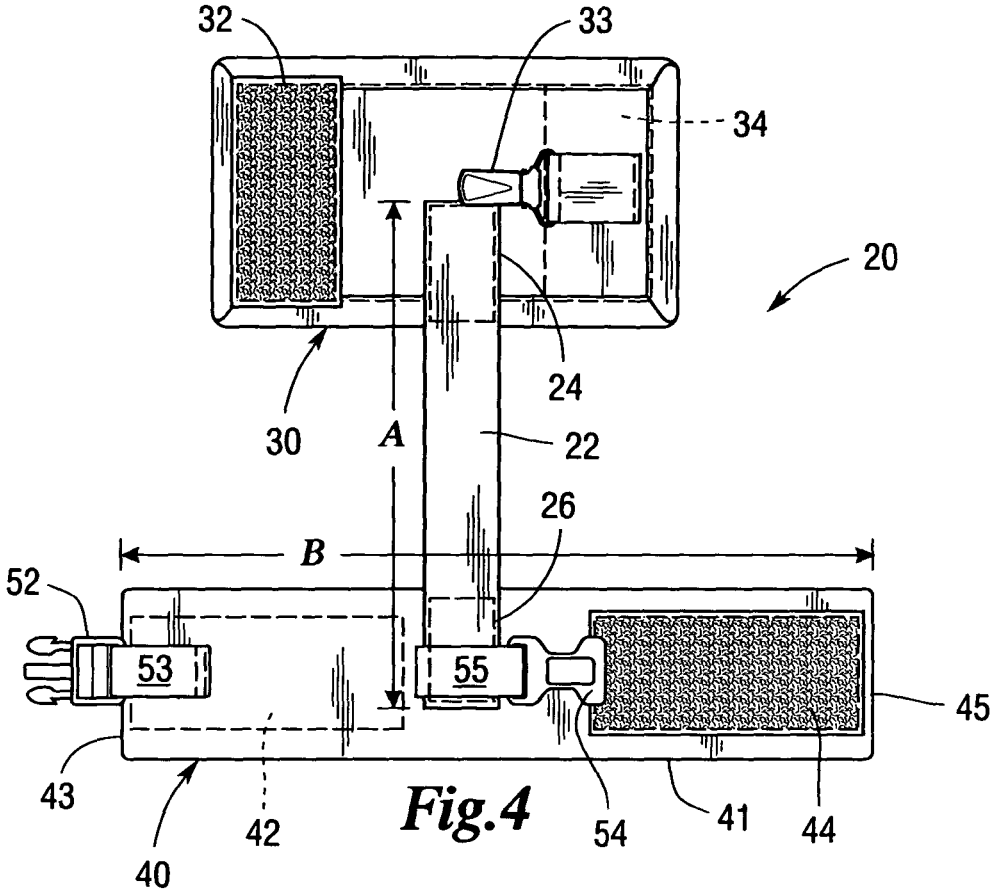
FIG. 4 is a front view of a first embodiment of the baby bottle leash of the present invention.
Figure 5:
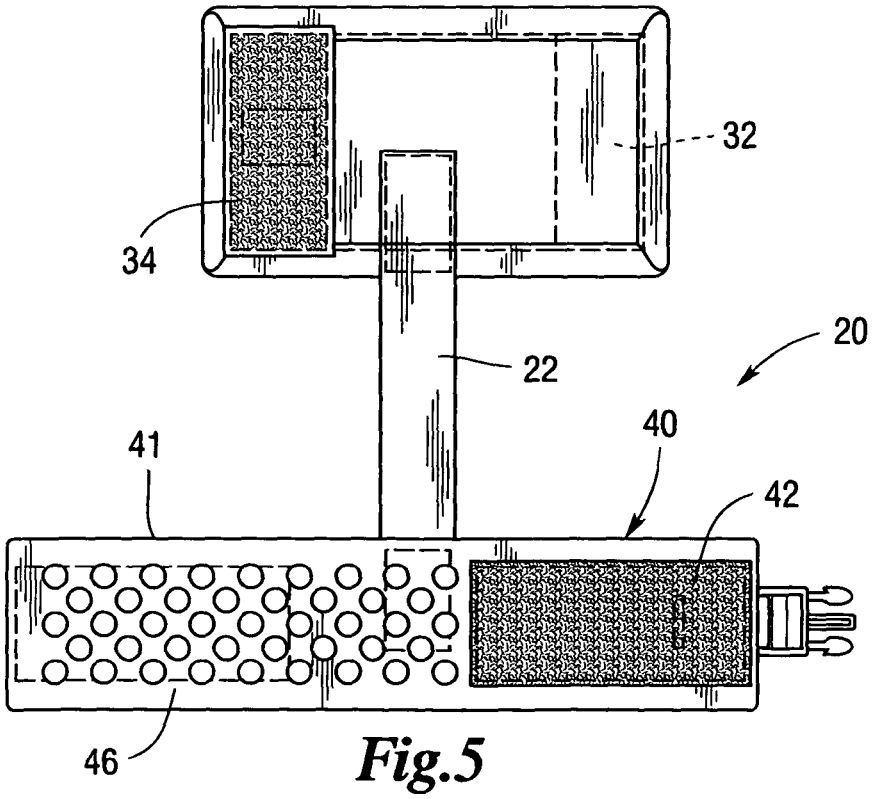
FIG. 5 is a back view of a first embodiment of the baby bottle leash of the present invention.

A first embodiment of the baby bottle leash is shown in FIGS. 1, 2, 4 and 5 generally at 20. As best seen in FIGS. 4 and 5, leash 20 is comprised of a strap 22 which has a length A extending between first end 24 and second end 26, with a first attachment band 30 secured to first end 24 of strap 22 as by stitching. Strap 20 is made of a non-stretch fabric such as canvas or a woven cotton or nylon, for example. First attachment band 30 has a first securement means in the form of first (32) and second (34) portions of hook-and-loop fabric attached as by stitching to opposite ends. Most preferably, first attachment band 30 is padded for the child's comfort since, as shown in FIG. 1, when it is secured to the shoulder harness strap 13 of car seat 11, it will come in contact with the child's shoulder/chest region. While it is possible for strap 20 to be constructed to be of adjustable length, it is not regarded as an essential feature of the leash of the present invention since the positioning of the bottle can be controlled by the positioning of the first attachment band on the shoulder harness strap. Strap 20 has an overall length A on the order of 6" to 8" providing an effective "dangle length" of 3" to 5". It will be understood that these lengths are intended as exemplary and not limiting. The dangle length is defined as the distance between first attachment band 30 and second attachment band 40. Although the baby bottle leash 20 of the present invention is described in conjunction with a car seat, it will be appreciated that it can also be used with a stroller, play station, layette, high chair, or other device.

Figure 3:
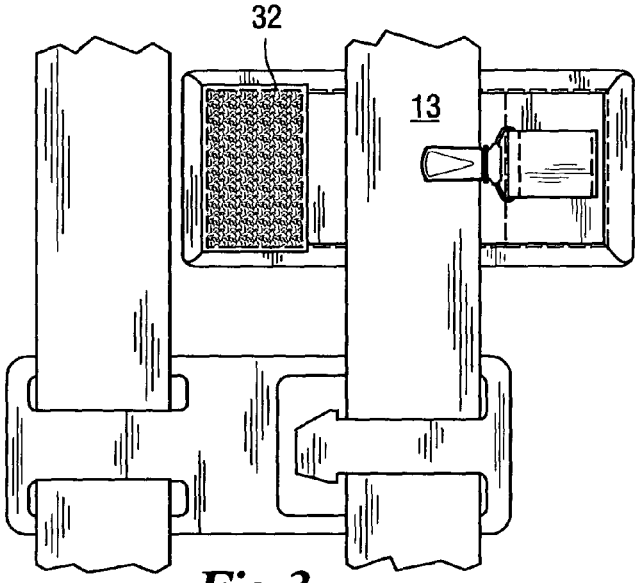
FIG. 3 is a detailed rear view of the first embodiment of the baby bottle leash of the present invention showing how it attaches to the right shoulder strap.

Confined within first attachment band 30 is an alligator clip 36 which securely fastens to the shoulder harness strap 13 (FIG. 3) and then band 30 is wrapped around the harness strap 13 and the first (32) and second (34) hook-and-loop fabric portions engaged to retain it in secured position at the desired location to position the bottle 15 as shown in FIG. 1. When so positioned, the bottle may be easily retrieved by the child should he/she momentarily lose his/her grip of it. Clip 36 may be an alligator clip or a suspender clip, with the latter being shown and preferred. By the use of the clip 36 to positively fix the position of the band 30 on the shoulder harness strap 13, the baby bottle leash cannot slide up or down on the strap 13 thereby mis-positioning the bottle 15. In addition, while the size of the first (32) and second (34) hook-and-loop fabric portions makes the band 30 "tamper-proof" for most children, the redundancy of clip 36 makes the attachment provided by band 30 "failsafe".

A second attachment band 40 is secured to the second lower end 26 of strap 22 as by stitching. Second attachment band 40 has a first latching means in the form of a fabric strip 41 having a length B. It should be noted that the length A of suspension strap 22 does not exceed the length B of fabric strip 41 which secures the bottle 15. This ensures that the bottle 15 remains within the grasp of the child in the car seat 11. Fabric strip 41 has a third elongated strip of hook-and-loop fabric 42 sewn (or alternatively secured) on a first end 43 and a fourth elongated strip of hook-and-loop fabric 44 sewn on second opposing end 45. These elongated lengths of attaching fabric afford the capability to accommodate varying sizes of containers such as bottles, sippy cups, etc. To further enhance this capability, fabric 42 is preferably made of a stretchable material such as SPANDEX fabric, or the like. Stitched (or alternatively secured) to a second side of fabric strip 41, opposite from first elongated hook-and-loop fabric strip 42, is a non-slip fabric 46 designed to secure the bottle 15. Non-slip fabric 46 is preferably elastomeric, being made of rubber or a rubber like material which accommodates the stretching of fabric strip 41. Alternatively, gripper dots may be applied to the bottle-engaging side of fabric 46 to make it non-slip. By way of example and not limitation, in this embodiment, first attachment band may measure 3.5" by 6.25" and the second attachment band may measure 2.5" by 11".

Second latching means, in the FIGS. 4-5 embodiment, comprises a two part, snap-together buckle 50 (FIG. 2) having first male member 52 and second female member 54. As shown in FIG. 4, male member 52 is stitched to an end of elastic 53 and female member 54 is stitched to the end of elastic 55 which is anchored to the end 26 of strap 22. By using elastics 53, 55, buckle portions 52, 54 can be stretched over the outside of fabric 41 after first and second hook-and-loop fabric portions are engaged to secure fabric 41 around bottle 15. Alternative means of adjustment can be employed if non-elastic fabric is utilized. Second latching means 50 secures first latching means 41 against possible tampering by the child should he/she become bored with the bottle 15. It is envisioned that other second latching means 50' and 50" shown in FIGS. 4A and 4B respectively, could take the form of center-release clips, snaps and buttons.

The second snap embodiment is depicted in FIG. 4A with the male snap 36A' being mounted on elastic 37A' and the female snap 36B' mounted on elastic 37B'. FIG. 4B depicts the third button embodiment in which the button 36A" is mounted on elastic 37A" and the button hole 36B" is mounted on elastic 37B". The snaps 36' and the buttons 36" work in exactly the same manner as the buckle 36 of the FIG. 4 embodiment, wrapping around fabric strip 41 to act as a redundant latching means that prevents tampering by the child or other undesired release of bottle 15.

Figure 6:
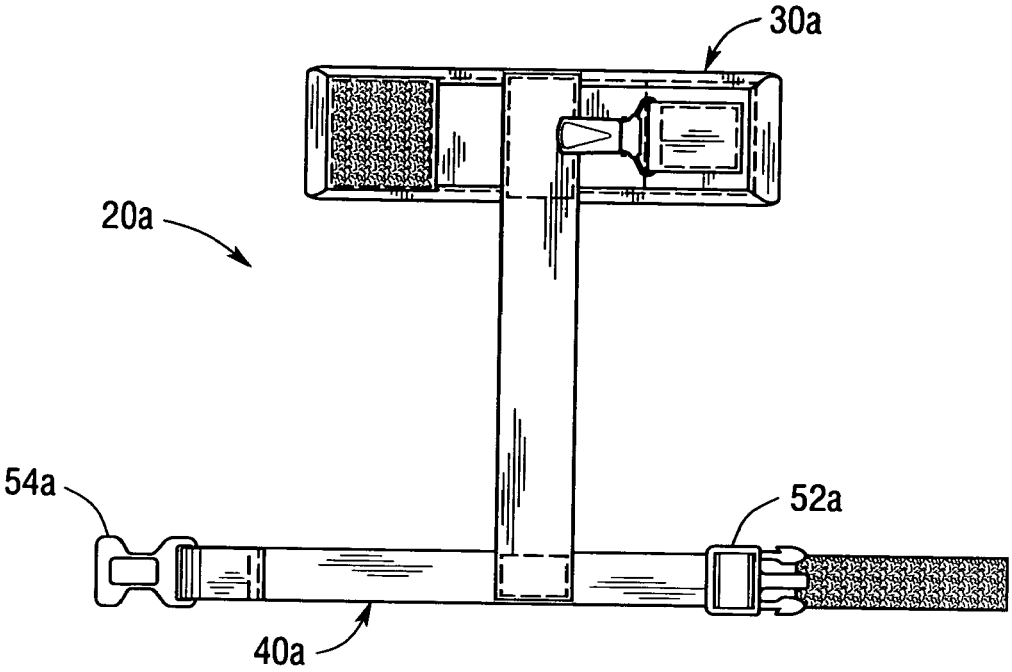
FIG. 6 is a front view of a fourth embodiment of the baby bottle leash of the present invention.
Figure 7:
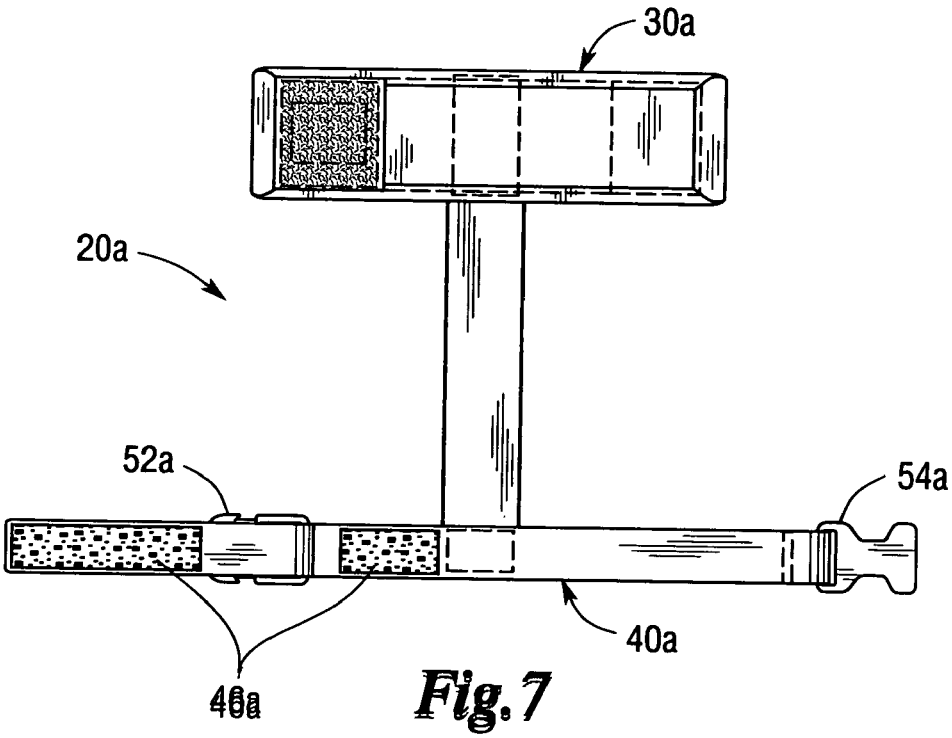
FIG. 7 is a back view of a fourth embodiment of the baby bottle leash of the present invention.

A fourth embodiment of the baby bottle leash is shown in FIGS. 6 and 7 generally at 20*a*. The operation of this fourth embodiment is substantially identical to that of the first three embodiments. The key differences are in the sizes of the first (30*a*) and second (40*a*) attachment bands. Again, by way of example and not limitation, first attachment band 30*a* measures 1.875" by 6.25" long. This change in size results, not only in a saving of fabric, but makes the first attachment band easier to manipulate. Second attachment band 40 is made of an elastic strap as opposed to SPANDEX fabric and measures 0.75" by 9". Additional changes include the reversing of the positions of the male (52*a*) and female (54*a*) buckle portions and the non-slip fabric 46*a* is reduced in overall length by about 50%, being divided into two lengths which will engage opposing sides of the bottle 15 or other container.

Figure 8:
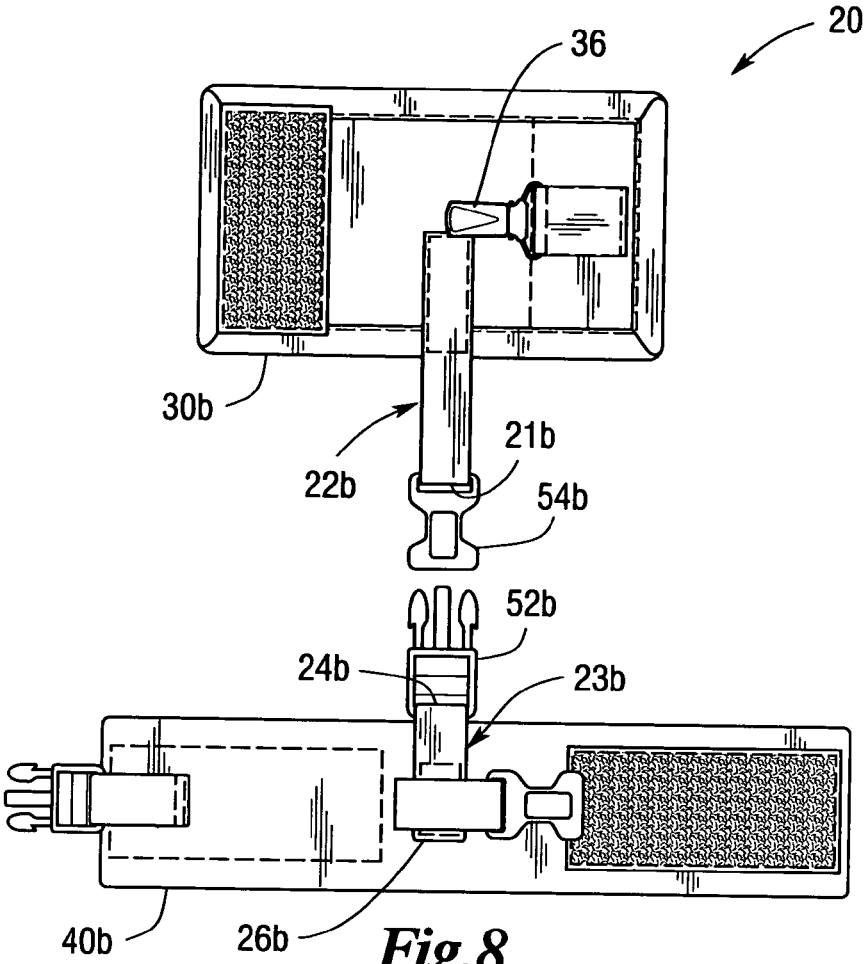
FIG. 8 is a front view of a fifth embodiment.

FIG. 8 depicts a fifth embodiment generally at 20*b*. This embodiment of the baby accessory suspension system 30*b*, is similar in most respects to that shown in FIG. 4, with first securement means comprising an alligator clip 36*b* that is surrounded by band 30*b* to prevent tampering. While band 30*b* is preferably padded for the baby's comfort, it will be appreciated that it could be comprised of SPANDEX fabric which, for some applications, may provide greater flexibility. It is noted that alligator clips, center-release clips, side-release clips, cam locks, snaps, buttons, double D-rings, and spring clips, typically require greater finger strength and manual dexterity to operate than most toddlers can muster. Accordingly, the use of any of these types of clips is sufficient to provide a tamper-resistant clip. The wrapping of the clip 36*b* by band 30*b* ensures the clip will remain attached. In this embodiment, suspension strap includes a third length of fabric 22*b* and a first length of fabric 23*b*, with the proximal end 21*b* of third length having a female receptacle 54*b* attached thereto. The distal end 25*b* of the third length of fabric 22*b* is attached to band 30*b* as by stitching. The proximate end 24*b* of first length of fabric 23*b* has a first clip 52*b* attached thereto. Proximate end 24*b* may be attached in such a way as to make it adjustable in length, as is known in the art, or the length of fabric may be made adjustable using a double-back clip in the center of its length. In fact, any of the suspension straps or attachment bands can be made adjustable in length. The distal end 26*b* of first length of fabric 23*b* is secured to a first attachment band 40*b* which, as depicted here, is configured to be secured to a bottle or other container.

Figure 10:
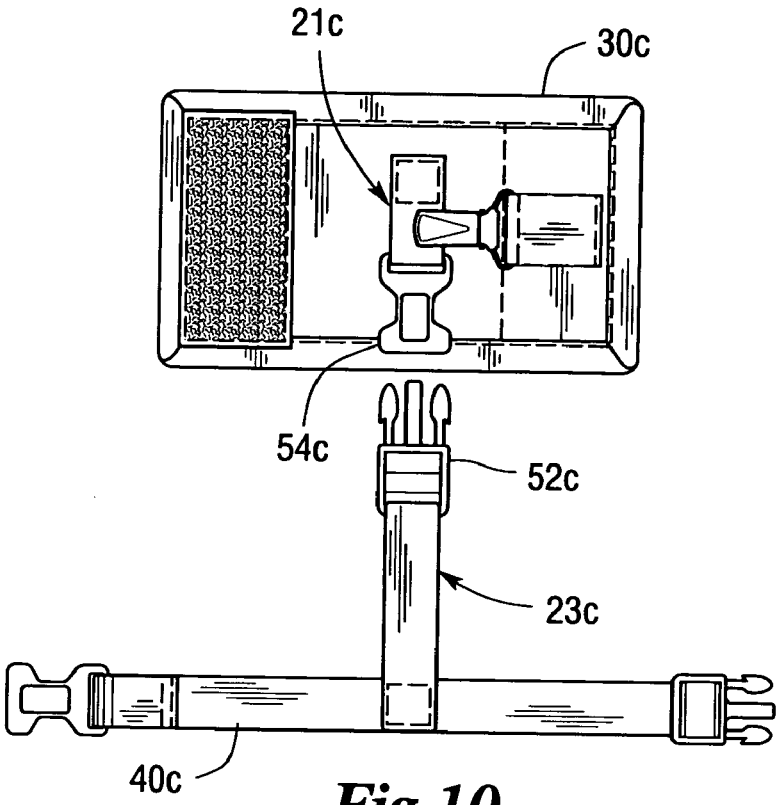
FIG. 10 is a front view of a seventh embodiment.

When it is desired to convert the bottle leash into a toy leash, the side-release clip 52*b* can be engaged to dislodge clip 52*b* from female receptacle 54*b* and remove band 40*b*; then, as depicted in FIG. 10, a second thinner strap 40*c* which is secured to a second clip 52*c* by second fabric length 23*c* can be utilized to secure a toy or similar article to female receptacle 54*b*. It will be appreciated that strap 40*c* may be adjustable to accommodate different sized objects. Alternatively, strap 40*c* may be made of stretchable elastic material such as SPANDEX. As noted with the FIG. 5 embodiment, gripping dots can be added to the inner surface of the strap 40*c* (or to any of these other to resist slippage. Another distinctive feature of the seventh embodiment of FIG. 10 is that third fabric length 21*c* is shortened to bring side-release clip portions 52*b*, 54*b* within the wrap 30*c* to ensure that the tamper-resistant clip cannot be manipulated by the toddler (sort of a "belt-and-suspenders" approach). It will be appreciated that this interchangeable feature may be afforded to other embodiments depicted herein, as well.

Figure 9:
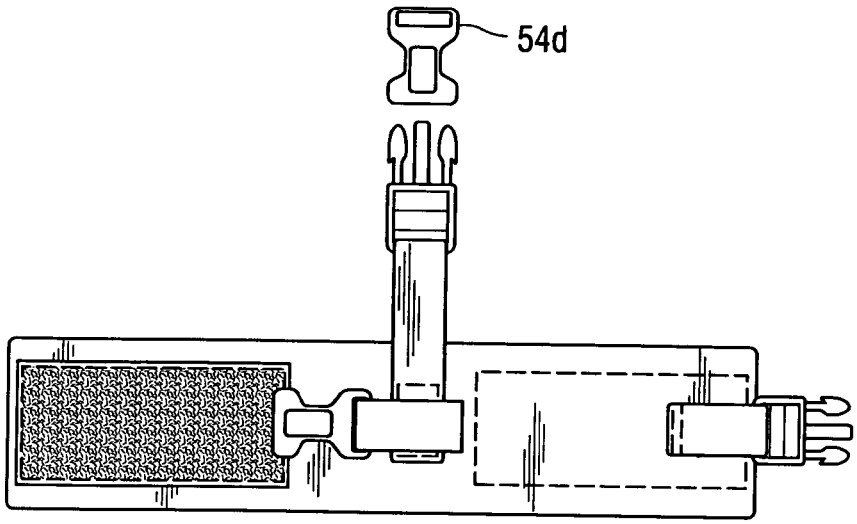
FIG. 9 is a front view of a sixth embodiment.
Figure 11:
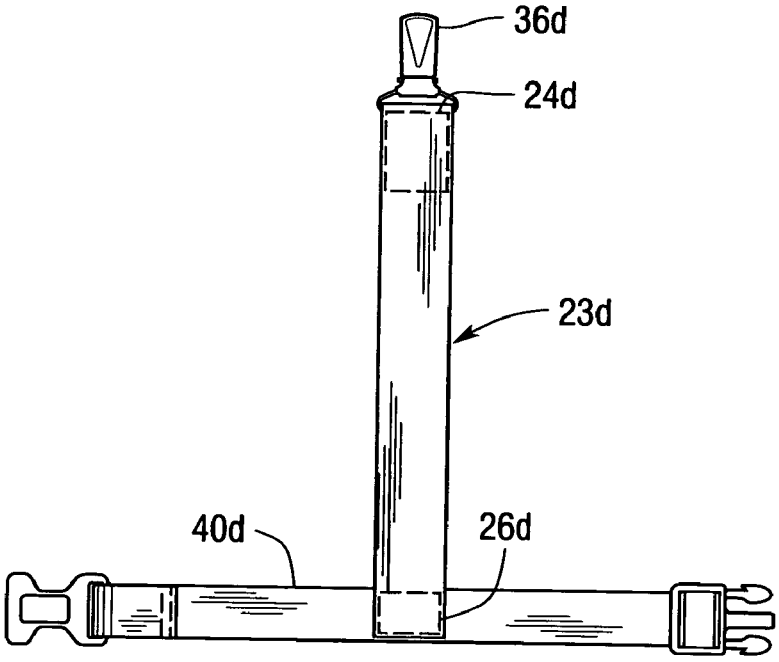
FIG. 11 is a front view of an eighth embodiment.

In the sixth embodiment depicted in FIG. 9, it is envisioned that the female receptacle 54*d* may be directly threaded onto a securement strap such as a shoulder strap of a car seat or high chair. The eighth embodiment, as shown in FIG. 11, depicts the invention in its simplest form: a tamper-resistant alligator clip 36*d* secured to the proximate end 24*d* of a strap 23*d* of a first fabric length, while the distal end 266 is secured to a second attachment band 40*d*. As noted earlier, attachment band may be stretchable or of fixed length fabric, depending on the specifics of the application.

Figure 12:
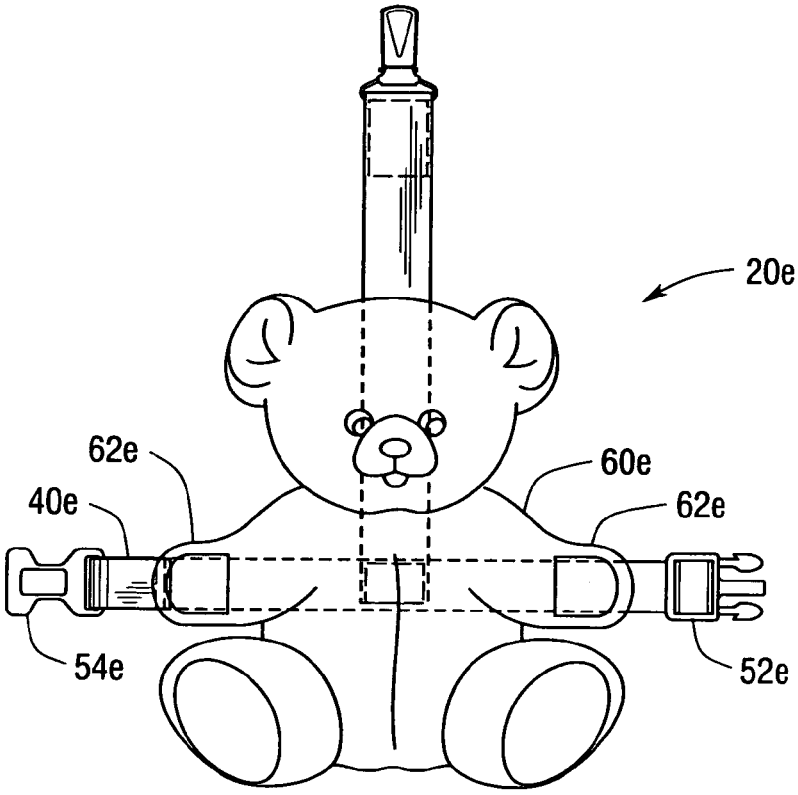
FIG. 12 is a front view of a ninth embodiment.

It is appreciated that, should the thinner attachment band 40*d*, for example, come loose from its attachment to suspension strap 22*d*, it could pose a possible choking hazard to an infant since putting things into its mouth is a primary source of entertainment for a baby. FIG. 12 depicts a ninth embodiment devised to combat this problem generally at 20*e*. In this embodiment, a toy, more specifically a stuffed animal, which in this specific embodiment takes the form of a teddy bear 60*e*, is integrally formed with attachment band 40*e*. While one example of how this safety feature may be implemented is depicted in FIG. 12, it will be appreciated that any number of alternatives exist, as well. For example, the size of the stuffed animal or other toy, relative to the size of the band 40*e* could be either larger or smaller. Further, although a separate band 40*e* is shown with clips 52*e*, 54*e* attached to its paws 62*e*, it will be appreciated that the clips 52*e*, 54*e* could be attached directly to paws 62*e* and the strap eliminated. Clearly, all four paws could be configured to provide a double wrap around the bottle or toy. Finally, if the paws 62*e* were equipped with pads of Velcro fabric, they could be wrapped around the toy item and secured, providing an adjustment feature. Alternatively, the proper selection of the stuffed animal (e.g., a monkey) could afford the opportunity to utilize the stuffed animal as the attachment band and the animal's tail as the suspension strap. It is also envisioned that a kangaroo could support the bottle or toy within her pouch. An alternative to the use of an animal would be to make the attachment band 40*d* of the padded variety, i.e., stuffed, to render it too large of ingestion and too soft for strangulation.

Figure 13:
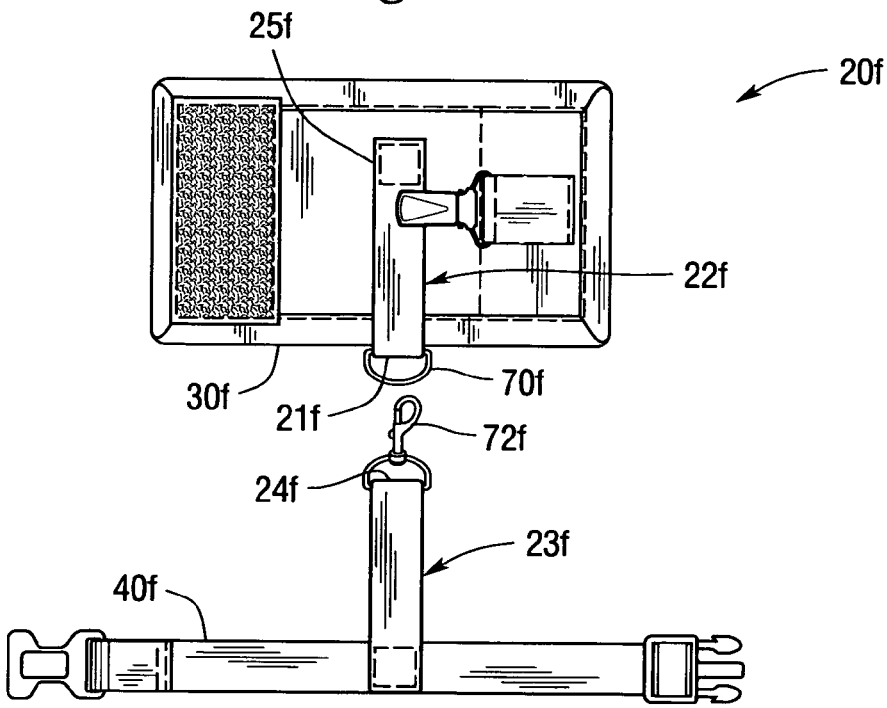
FIG. 13 is a front view of a tenth embodiment.

FIG. 13 depicts a tenth embodiment generally at 20*f*. This embodiment employs a D-ring 70*f* attached to proximate end 21*f* of third fabric length 22*f*, with distal end 25*f* secured to the band 30*f* as by stitching. Suspension strap 40*f* is secured using a spring clip 72*f* attached to proximate end 24*f* of first fabric length 23*f*. The spring clip 72*f* may be easily clipped to and released from D-ring 70*f* by the custodial adult. However, toddlers lack the manual dexterity and finger strength necessary to operate the spring clip 72*f*. Accordingly, this embodiment is also child proof. It is within the scope of the teachings of this disclosure to enclose the D-ring and spring clip with the band 30*f* to provide an additional level of tamper-resistance.

The baby bottle leash 20 of the present invention secures the bottle 15 or other container in ready reach of the child even should he/she temporarily lose his/her grip thereon. Because the bottle remains within easy reach, the child may recapture the bottle without requiring intervention of the parent. Even should the parent need to "come to the rescue", rummaging around on the floor of the back seat will not be part of the exercise. In several embodiments, each of the first (30) and second (40) attachment bands have redundant securement means and latching means, respectively, to produce a failsafe system 20 for keeping the bottle 15 or other container, on the leash. Alternative second attachment bands 40 can be secured to first attachment bands 30 by a variety of clips (52, 54; 70, 72) to allow a parent to switch back and forth between the child's favorite toy or binky and the bottle, as need warrants.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A leash system for a child's accessory, said leash system comprising a) a strap having a first fabric length with a first and second end;

b) a first securement means for attaching said first fabric length to a fixed location, said first securement means comprising a tamper-proof clip;

c) a first attachment band surrounding said first securement means to ensure attachment of said tamper-proof clip by limiting access thereto;

d) a second attachment band secured to said second end of said strap for securely attaching to the child's accessory;

whereby said first securement means and said second attachment band provide a fail-safe leash system for maintaining the child's accessory within reach of a child.

2. The leash system of claim 1 wherein said tamper-proof clip is selected from a group consisting of an alligator clip, a center-release clip, a side-release clip, spring clip, swivel snap hook, snaps and buttons.

3. The leash system of claim 2 wherein said tamper-proof clip is an alligator clip.

4. The leash system of claim 1 wherein said second attachment band is adjustable to accommodate different sized articles.

5. The leash system of claim 4 wherein said second attachment band is made of a stretchable elastic material to accommodate different sized articles.

6. The leash system of claim 1 wherein at least one of said strap and said band have adjustment means allowing its length to be altered.

7. The leash system of claim 1 wherein a toy is irremovably attached to said second attachment band to minimize a choking hazard should said second attachment band become disassociated with said strap.

8. The leash system of claim 7 wherein said toy comprises a stuffed animal whose arms are integral with said second attachment band.

9. The leash system of claim 8 wherein said stuffed animal comprises a teddy bear.

10. A leash system for a child's accessory, said leash system comprising a) first securement means for attaching said leash to a fixed location;

b) a first clip securable to said first securement means, said first clip being attached to a first end of a first length of fabric, a first attachment band secured to a second end of said first length of fabric, said first attachment band being adapted to secure a first type of child's accessory;

c) a second clip alternatively securable to said first securement means, said second clip being attached to a first end of a second length of fabric, a second attachment band secured to a second end of said second length of fabric, said second attachment band being adapted to secure a second type of child's accessory;

whereby said first and second clips may alternatively be attached to said first securement means to enable said leash system to accommodate multiple types of child accessories.

11. The leash system of claim 10 wherein said at first securement means includes a second securement means surrounding said first securement means preventing tampering with said first securement means.

12. The leash system of claim 11 wherein said second securement means comprises a padded fabric band to ensure the child's comfort.

13. The leash system of claim 12 wherein said band of said second securement means is retained in a wrapped position by first and second portions of hook-and-loop fabric.

14. The leash system of claim 11 wherein said first securement means comprises a female receptacle for said first and second clips.

15. The leash system of claim 14 wherein said female receptacle is directly attached to an end portion of a child restraining strap.

16. The leash system of claim 14 wherein said female receptacle is attached to an end of a third length of fabric, said third length of fabric being attached to said second securement means.

* * * * *